US012527456B2

(12) United States Patent
Czarnecki et al.

(10) Patent No.: US 12,527,456 B2
(45) Date of Patent: Jan. 20, 2026

(54) AUTOMATIC SLIDING AIR KNIFE FOR A DISHWASHER

(71) Applicant: WHIRLPOOL CORPORATION, Benton Harbor, MI (US)

(72) Inventors: Philip J. Czarnecki, Saugatuck, MI (US); Mark S. Feddema, Kalamazoo, MI (US); Stephanie Camazzola Godoshian, St. Joseph, MI (US); Gautam Prakash Kamat, St. Joseph, MI (US); Vilas D. Raut, Pune (IN); Annie M. Stuart, Kalamazoo, MI (US); Akshay S. Tondwal, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 132 days.

(21) Appl. No.: 18/420,221

(22) Filed: Jan. 23, 2024

(65) Prior Publication Data

US 2025/0235074 A1 Jul. 24, 2025

(51) Int. Cl.
*A47L 15/48* (2006.01)

(52) U.S. Cl.
CPC ..... *A47L 15/486* (2013.01); *A47L 2501/12* (2013.01)

(58) Field of Classification Search
CPC ..... A47L 15/486
See application file for complete search history.

(56) References Cited

U.S. PATENT DOCUMENTS

| | | | |
|---|---|---|---|
| 6,053,185 | A | 4/2000 | Beevers |
| 8,226,778 | B2 | 7/2012 | Kramer |
| 9,888,829 | B1 | 2/2018 | Bongivengo |
| 10,524,634 | B2 | 1/2020 | Digman |
| 10,980,395 | B2 | 4/2021 | Kim et al. |
| 11,241,140 | B2 | 2/2022 | Jung et al. |
| 11,246,469 | B2 | 2/2022 | Jung et al. |
| 11,672,404 | B2 | 6/2023 | Wolowicz et al. |
| 11,800,963 | B2 | 10/2023 | Digman et al. |
| 11,819,175 | B2 | 11/2023 | Ang |
| 11,825,998 | B2 | 11/2023 | Lutz et al. |
| 2019/0053686 | A1 | 2/2019 | Weigle |
| 2022/0296075 | A1 | 9/2022 | Stickel et al. |

(Continued)

FOREIGN PATENT DOCUMENTS

| | | | |
|---|---|---|---|
| CN | 110897573 | A | 3/2020 |
| DE | 102021100944 | A1 | 7/2022 |
| DE | 102015013364 | B4 | 5/2023 |

(Continued)

*Primary Examiner* — Spencer E. Bell

(74) *Attorney, Agent, or Firm* — Price Heneveld LLP

(57) ABSTRACT

A dishwasher includes a tub having a top wall and opposing sidewalls that at least partially define a washing chamber. A housing coupled to the top wall of the tub. A motor disposed in the housing. A lead screw operably coupled to the motor, the lead screw extends between the opposing sidewalls of the tub. An air knife assembly is operably coupled to the lead screw. The air knife assembly is operable between a stowed state and a deployed state. The motor drives rotation of the lead screw to move the air knife assembly, the air knife assembly including, an air knife defining an air inlet and an air outlet, and a blower coupled to the air knife. The blower is configured to direct air through the air outlet of the air knife to generate an air curtain when the air knife assembly is in the deployed state.

20 Claims, 14 Drawing Sheets

(56) References Cited

U.S. PATENT DOCUMENTS

| | | | |
|---|---|---|---|
| 2023/0292984 | A1 | 9/2023 | Almus et al. |

FOREIGN PATENT DOCUMENTS

| | | | |
|---|---|---|---|
| EP | 3797668 | B1 | 5/2022 |
| EP | 3998009 | B1 | 3/2023 |
| JP | H08215128 | A | 8/1996 |
| JP | 2894545 | B2 | 5/1999 |
| KR | 101202103 | B1 | 11/2012 |

AUTOMATIC SLIDING AIR KNIFE FOR A DISHWASHER

BACKGROUND OF THE DISCLOSURE

The present disclosure generally relates to a sliding air knife drying assembly, and more specifically, to an automatic sliding air knife for a dishwashing appliance.

SUMMARY OF THE DISCLOSURE

According to one aspect of the present disclosure, a dishwasher includes a tub having a top wall and opposing sidewalls that at least partially define a washing chamber. A housing is coupled to the top wall of the tub, and a motor is disposed in the housing. A lead screw is operably coupled to the motor and extends between the opposing sidewalls of the tub. A support member is coupled to the housing and extends between the opposing sidewalls of the tub. An air knife assembly is operably coupled to the lead screw and the support member. The air knife assembly is operable between a stowed state abutting the housing and a deployed state moving along the lead screw and the support member between the opposing sidewalls. The motor drives rotation of the lead screw to move the air knife assembly. The air knife assembly has an air knife that defines an air inlet and an air outlet, and a blower that is coupled to the air knife. The blower directs air through the air outlet of the air knife to generate an air curtain when the air knife assembly is in the deployed state.

According to another aspect of the present disclosure, a dishwasher includes a tub having a top wall and a housing coupled to the top wall of the tub. The housing defines a receiving cavity. A motor is disposed in the housing. A lead screw is operably coupled to the motor and the tub. A support member is coupled to the housing and the tub, and an air knife assembly is operably coupled to the lead screw and the support member. The air knife assembly is operable between a stowed state and a deployed state. The air knife assembly includes an air knife defining a slit forming an air outlet. The motor drives rotation of the lead screw to translate the air knife assembly along the lead screw when in the deployed state. A blower housing is coupled to the air knife. The blower housing is configured to be positioned in the receiving cavity and to abut the housing when the air knife assembly is in the stowed state to seal an air inlet of the air knife assembly. A blower is disposed in the blower housing. The blower is configured to direct air through the air outlet to generate an air curtain when the air knife assembly is in the deployed state.

According to yet another aspect of the present disclosure, a dishwasher includes a tub having a top wall and first and second sidewalls. The tub defines a washing chamber and an opening in the top wall. A dishrack is disposed in the washing chamber and configured to hold dishes. A housing is disposed in the opening of the top wall of the tub proximate to the first sidewall. A motor is disposed in the housing, and a lead screw is operably coupled to the motor. The lead screw extends between the motor housing and the second sidewall. An air knife assembly is operably coupled to the lead screw. The air knife assembly includes an air knife defining an air inlet and an air outlet. The air outlet forms an elongated slit. A blower housing is coupled to the air knife, and a blower is disposed in the blower housing. The blower is configured to direct air through the air outlet of the air knife to generate an air curtain in a downward direction across a depth of the dishrack, the elongated slit forming the air curtain in a fan shape.

These and other features, advantages, and objects of the present disclosure will be further understood and appreciated by those skilled in the art by reference to the following specification, claims, and appended drawings.

Figure 1:
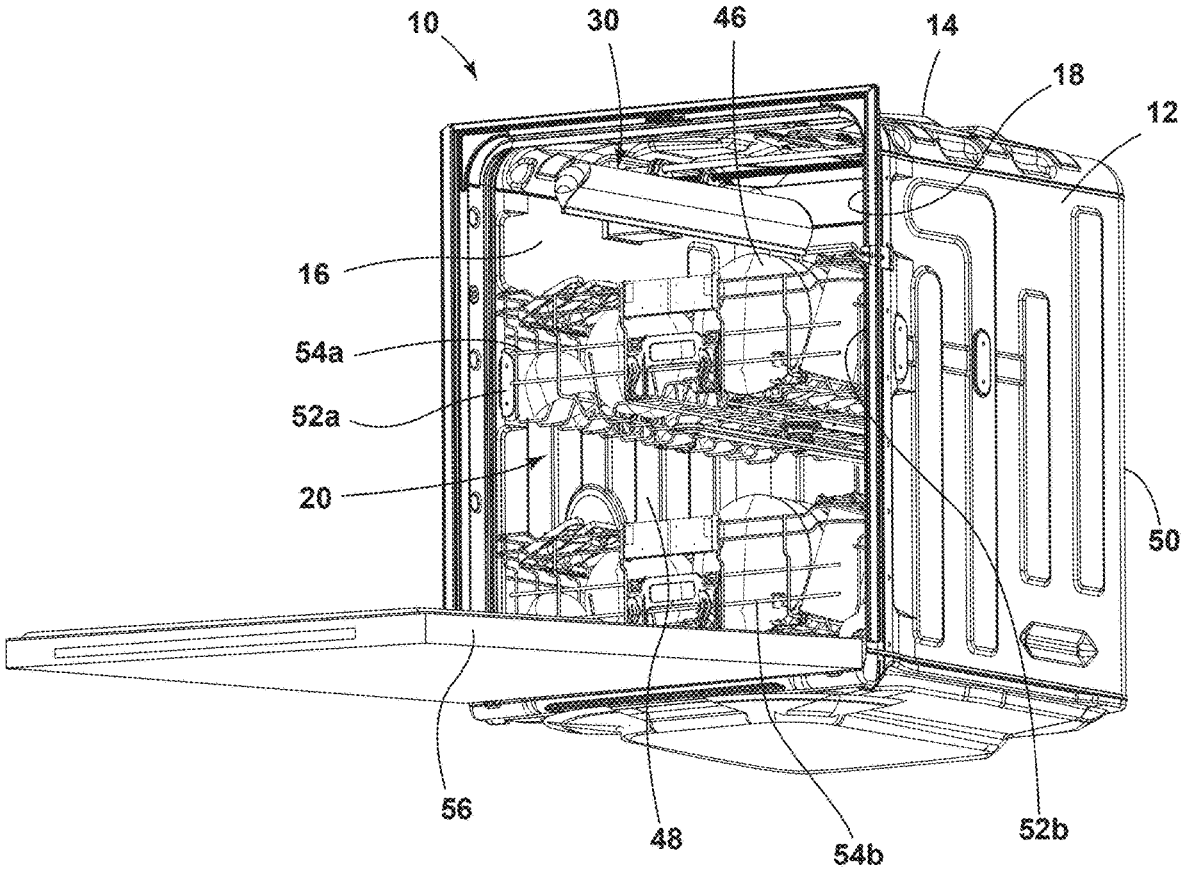
FIG. 1 is a side perspective view of an air knife drying assembly within a washing chamber of a dishwashing appliance, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to an automatic sliding air knife for a dishwasher. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-14, reference numeral 10 generally designates a dishwashing appliance or dishwasher 10. The dishwasher 10 includes a tub 12 having a top wall 14 and opposing sidewalls 16, 18 that at least partially define a washing chamber 20. A housing 22, which may also be referred to as a support housing 22, is coupled to the top wall 14 of the tub 12, and a motor 24 is disposed in the housing 22. A lead screw 26 is operably coupled to the motor 24 and extends between the opposing sidewalls 16, 18 of the tub 12. A support member 28 is coupled to the housing 22 and extends between the opposing sidewalls 16, 18 of the tub 12. An air knife assembly 30, also referred to as a drying assembly, is operably coupled to the lead screw 26 and the support member 28. The air knife assembly 30 is operable between a stowed state 32 abutting the housing 22 and a deployed state 34 moving along the lead screw 26 and the support member 28 between the opposing sidewalls 16, 18. The motor 24 drives rotation of the lead screw 26 to move the air knife assembly 30. The air knife assembly 30 includes an air knife 36 that defines an air inlet 38 and an air outlet 40, and a blower 42 that is coupled to the air knife 36. The blower 42 directs air through the air outlet 40 of the air knife 36 to generate an air curtain 44 when the air knife assembly 30 is in the deployed state 34.

Referring to FIG. 1, the dishwasher 10 includes the tub 12 which defines the washing chamber 20 in which dishes 46 can be placed to be washed and dried. The tub 12 defines a front opening 48 for accessing the washing chamber 20. Additionally, the tub 12 includes the opposing sidewalls 16, 18 and a rear wall 50 extending between the opposing sidewalls 16, 18 and opposite the front opening 48. The top wall 14 of the tub 12 connects the opposing sidewalls 16, 18 and the rear wall 50 to define the washing chamber 20. Guide members 52*a*, 52*b* are coupled to the sidewalls 16, 18, respectively, to support upper dishrack 54*a* and lower dishrack 54*b* that are disposed within the washing chamber 20. In this way, the dishwasher 10 includes a set of upper guide members 52*a*, 52*b* to support the upper dishrack 54*a* and a set of lower guide members 52*a*, 52*b* to support the lower dishrack 54*b*. The dishracks 54*a*, 54*b* are movable along the guide members 52*a*, 52*b* to be positioned in the washing chamber 20 and for extending out of the washing chamber 20.

A door 56 is rotatably coupled to the tub 12. The door 56 is operable between an opened position to access the washing chamber 20 via the front opening 48 of the tub 12 and a closed position to enclose the washing chamber 20. In certain aspects, the door 56 may be manually adjusted by a user between the opened and closed positions. When the door 56 is in the opened position, the user may move and adjust the upper and lower dishracks 54*a*, 54*b* to extend beyond the front opening 48 of the tub 12 of the dishwasher 10.

During operation, the dishwasher 10 proceeds through various cycles to clean and dry the dishes 46 including at least one wash cycle and at least one dry cycle. The dishwasher 10 contains a first spray bar 58 disposed proximate to the top wall 14 of the tub 12 in the washing chamber 20 (see FIGS. 6 and 10). The first spray bar 58 directs water downward through a plurality of nozzles onto the dishes 46. In certain aspects, the first spray bar 58 is configured to continuously rotate for a predetermined length of time during the wash cycle to maximize an area where the first spray bar 58 directs washing fluid. The first spray bar 58 generally provides water coverage for the dishes 46 disposed in the upper dishrack 54*a*.

Additionally or alternatively, a second spray bar may be included proximate to the lower dishrack 54*b* to direct water upward through a plurality of nozzles onto the dishes 46 on the lower dish rack 54*b*. The use of the first spray bar 58 and the second spray bar can assist with maximizing the area where the washing fluid is sprayed over the dishes 46. The dishwasher 10 may include additional spray bars without departing from the teachings herein. Additionally, additional components may be included in the dishwasher 10 to generate or direct washing fluids in the dishwasher 10, where the washing fluid can include water and/or cleaning solution.

Heating elements may be located in one or more locations throughout the tub 12 of the dishwasher 10 to provide heat to assist in the removal of excess water remaining on the dishes 46 after completion of the wash cycle. In certain aspects, the heating elements may include a heating element that can heat the water, which may be referred to as an integrated heater. Additionally or alternatively, the heating element can heat both the water and the air within the washing chamber 20, which may be referred to as a calrod heater. Further, the dishwasher 10 can include pumps for removing water, fluid, and/or moisture from the tub 12 during a dry cycle. Moreover, the dishwasher 10 may include a fan to assist the drying process.

The dishwasher 10 may perform one or more cycles to clean and dry the dishes 46, including, but not limited to, a pre-wash fill cycle, a main wash cycle, one or more rinse cycles, a drying assembly translation cycle, and a drying cycle. Detergent is dispensed or otherwise introduced into the tub 12 during the main wash cycle and circulated by the first spray bar 58 and/or the second spray bar to wash the dishes 46 in the upper and lower dishracks 54*a*, 54*b*. The transitions between and order of the dishwashing cycles are generally controlled electronically at certain points of the various cycles based on set programs and/or feedback from a sensor 60 via a control system of the dishwasher 10 including a controller 62 (see FIG. 13).

A user interface 64 including a display 66 (see FIG. 13), or other interactive components, is disposed on the dishwasher 10, such as on the door 56. The user interface 64 provides the user with various options, including selecting and initiating an automatic dishwashing process. Additionally, the user may initiate any of the various wash and dry cycles in isolation by engaging with the user interface 64. Generally, the air knife assembly 30 undergoes an automatic translation cycle upon completion of the various wash cycles and prior to the drying cycle as described herein. In other words, the controller 62 may automatically activate the air knife assembly 30 and the motor 24 upon, or in response to, completion of the wash cycle(s). However, the translation cycle may be manually selected by the user via the user interface 64. Further, the translation cycle may be performed in isolation or at other times relative to other cycles of the dishwasher 10 without departing from the teachings herein.

Figure 2:
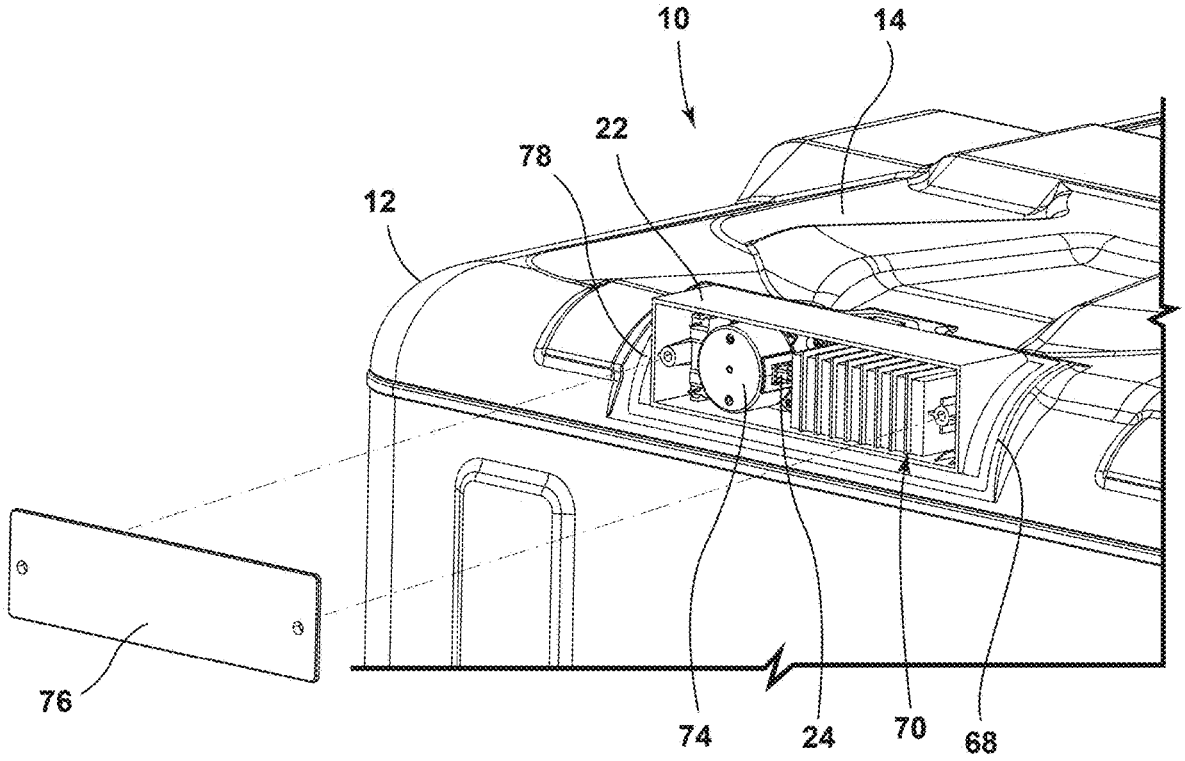
FIG. 2 is a side perspective view of an external portion of a housing coupled to a tub of a dishwashing appliance, according to the present disclosure.
Figure 3:
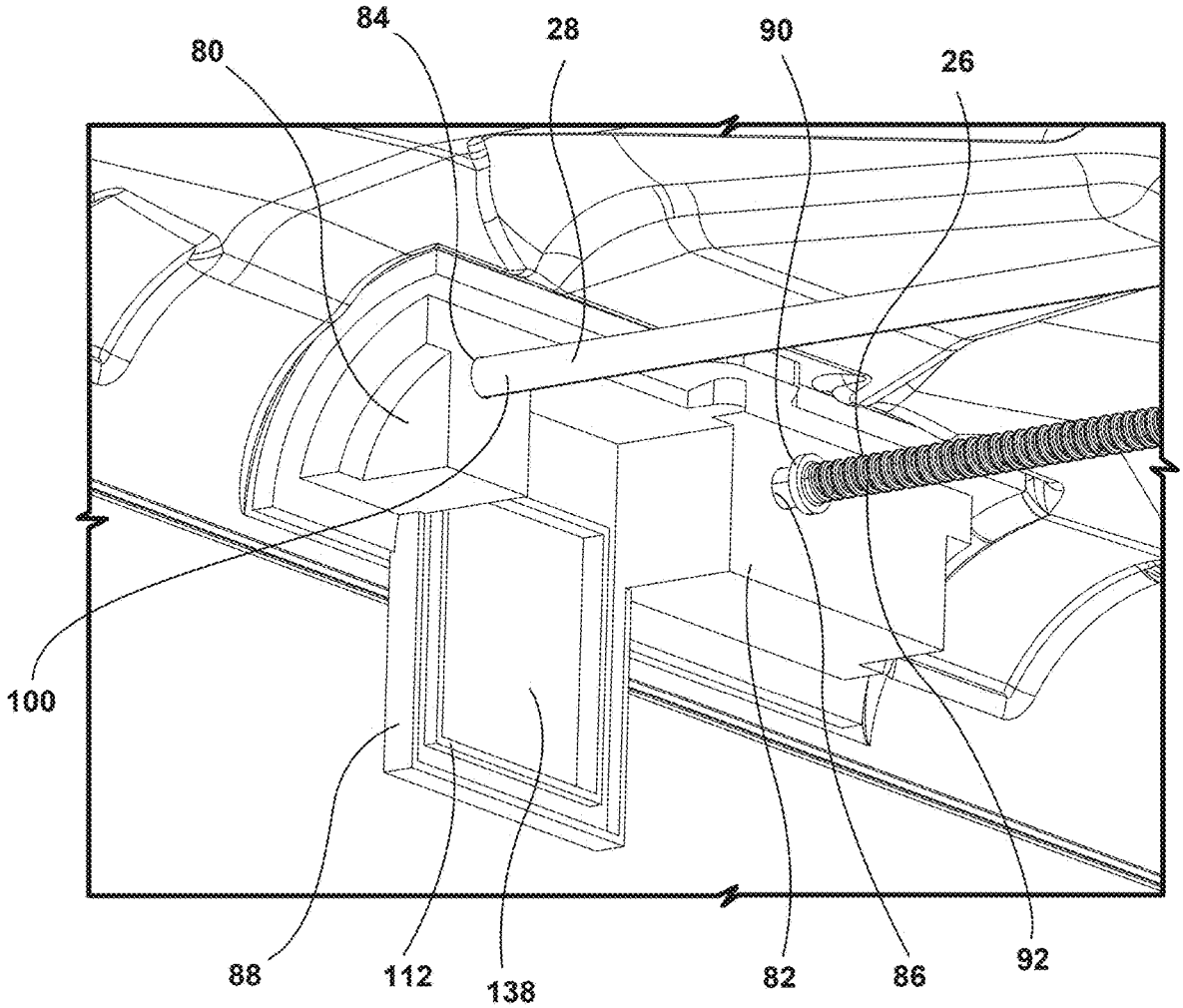
FIG. 3 is a side perspective view of an internal portion of a housing for a dishwashing appliance, according to the present disclosure.
Figure 4:
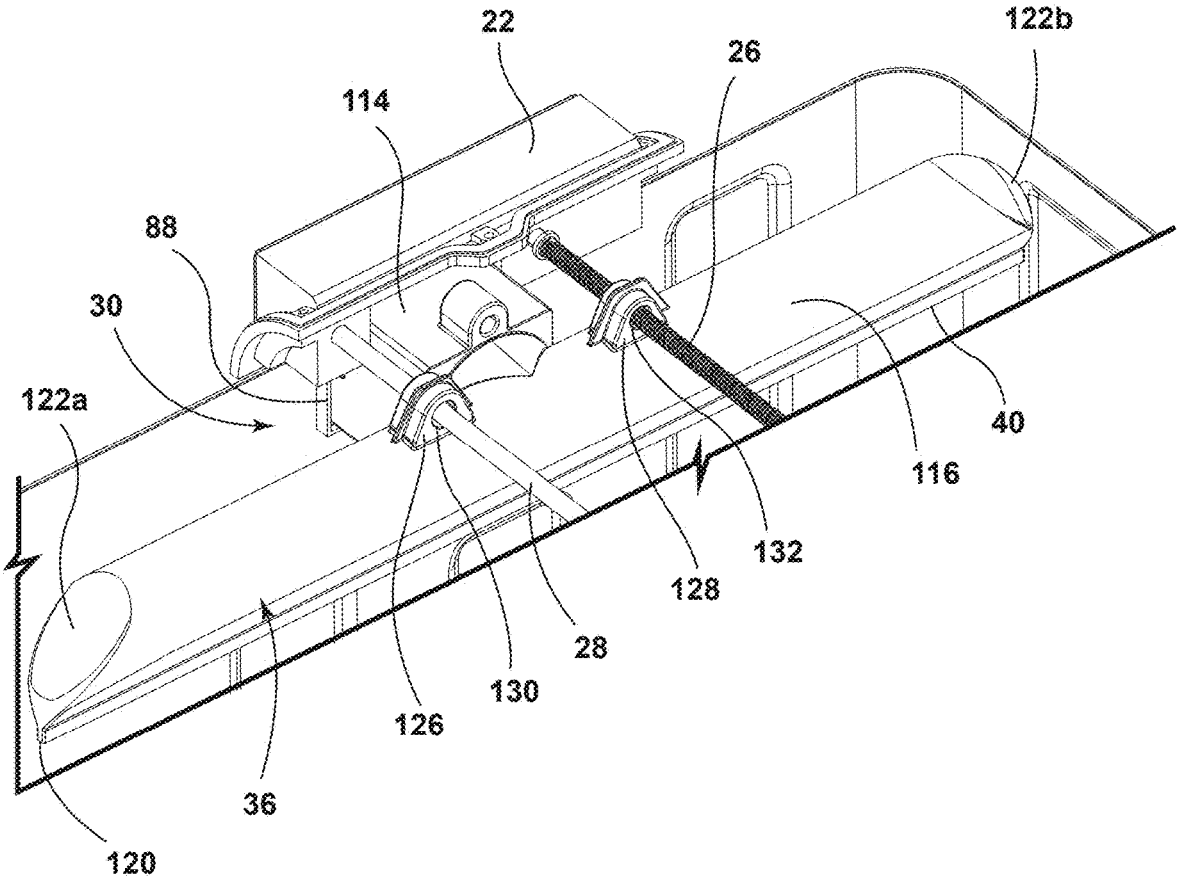
FIG. 4 is a side perspective view of an air knife assembly in a stowed state, according to the present disclosure.

Referring to FIGS. 2-4, the top wall 14 of the tub 12 defines an opening 68. As illustrated, the opening 68 is proximate to or at a corner with the first sidewall 16. Further, the opening 68 is generally defined in a central location relative to a depth of the washing chamber 20. The opening 68 provides fluid communication between the washing chamber 20 and an area exterior to the tub 12.

The housing 22 is disposed in the opening 68 of the tub 12 and generally fills the opening 68. The housing 22 extends through the top wall 14 of the tub 12 and into the washing chamber 20. Accordingly, the housing 22 includes an external portion 70 outside of the washing chamber 20 and an internal portion 72 within the washing chamber 20. The external portion 70 of the housing 22, located outside of the washing chamber 20, includes a motor housing 74 and a cover 76. The cover 76 overlays the external portion 70 of the housing 22 to protect the motor 24 from damage or debris. Additionally, the cover 76 allows for efficient heat dissipation when the motor 24 is activated. Additionally, a seal 78 extends along a perimeter of the housing 22 to reduce or prevent water leakage outside of the washing chamber 20 during the various wash cycles, as well as reduce or prevent materials from entering the washing chamber 20 via the opening 68.

The internal portion 72 includes side projections 80, 82 that define recesses 84, 86 and a receiving cavity 88 between the lateral projections 68, 70. The receiving cavity 88 assists in providing structural support for the air knife assembly 30 when in the stowed state 32 and provides a seal against water leakage into the air knife assembly 30 when the air knife assembly 30 is in the stowed state 32.

The motor 24 is disposed in the motor housing 74 in the external portion 70 of the housing 22. The motor 24 includes a driveshaft 90 that extends into the internal portion 72 of the housing 22 and is disposed within side projection 82 of the housing 22. The motor 24 is electrically powered and controlled by the controller 62 to activate and deactivate rotation of the lead screw 26 at select times during operation of the dishwasher 10.

Figure 5:
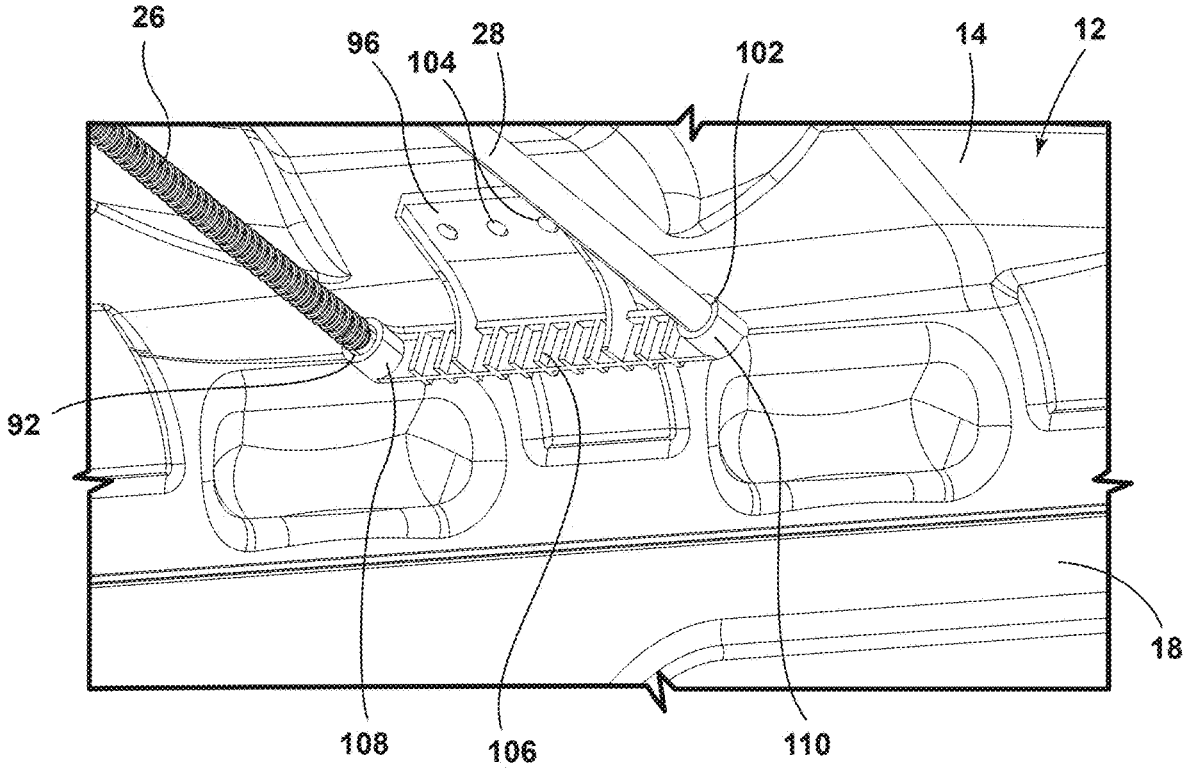
FIG. 5 is a side perspective view of a retaining feature for supporting a lead screw and a support member for a dishwashing appliance, according to the present disclosure.
Figure 6:
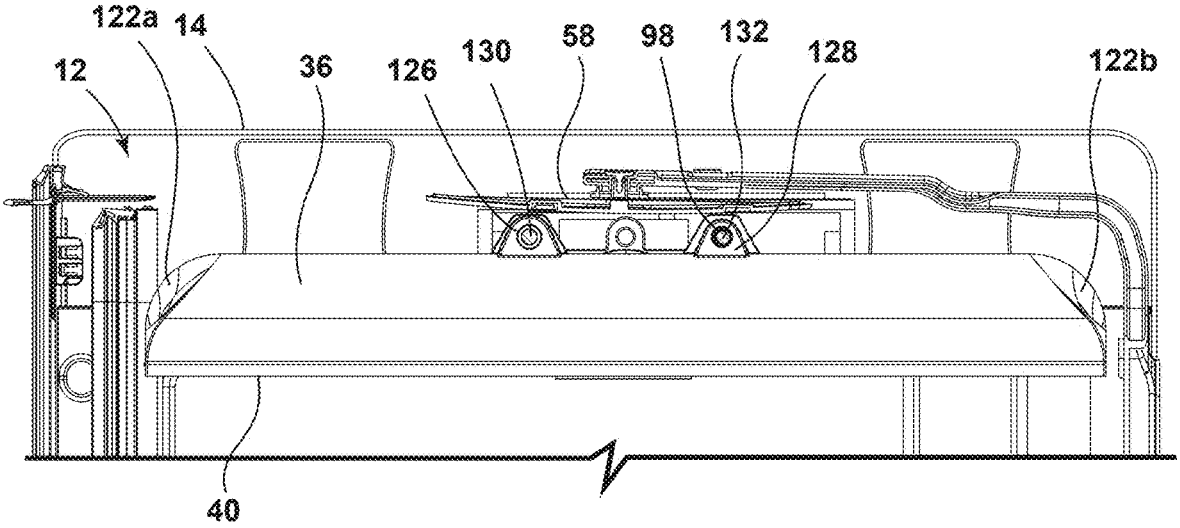
FIG. 6 is a side elevational view of an air knife assembly for a dishwashing appliance, according to the present disclosure.
Figure 7:
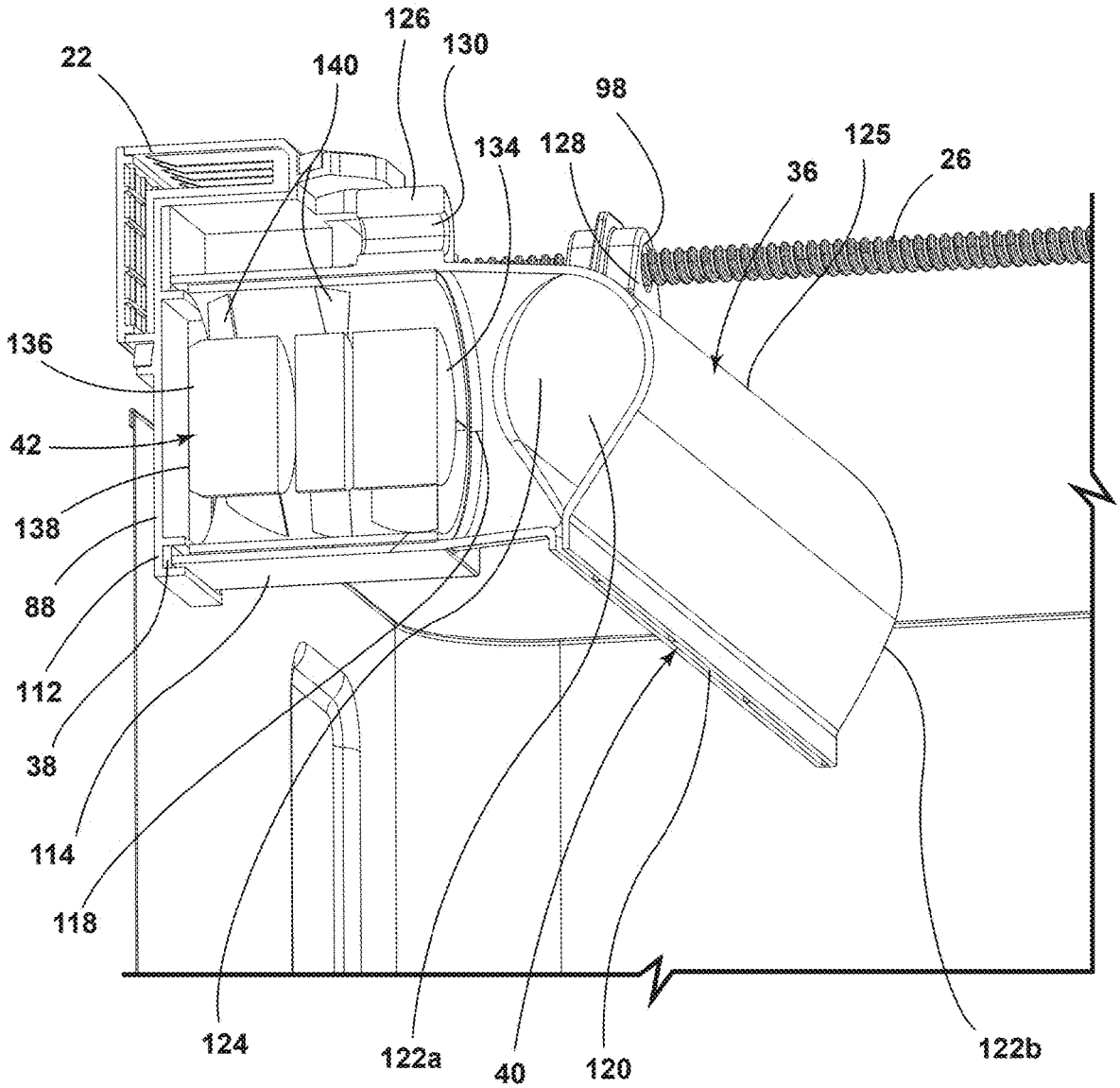
FIG. 7 is a side perspective cross-sectional view of an air knife assembly with a blower coupled to an air knife of the air knife assembly, according to the present disclosure.
Figure 8:
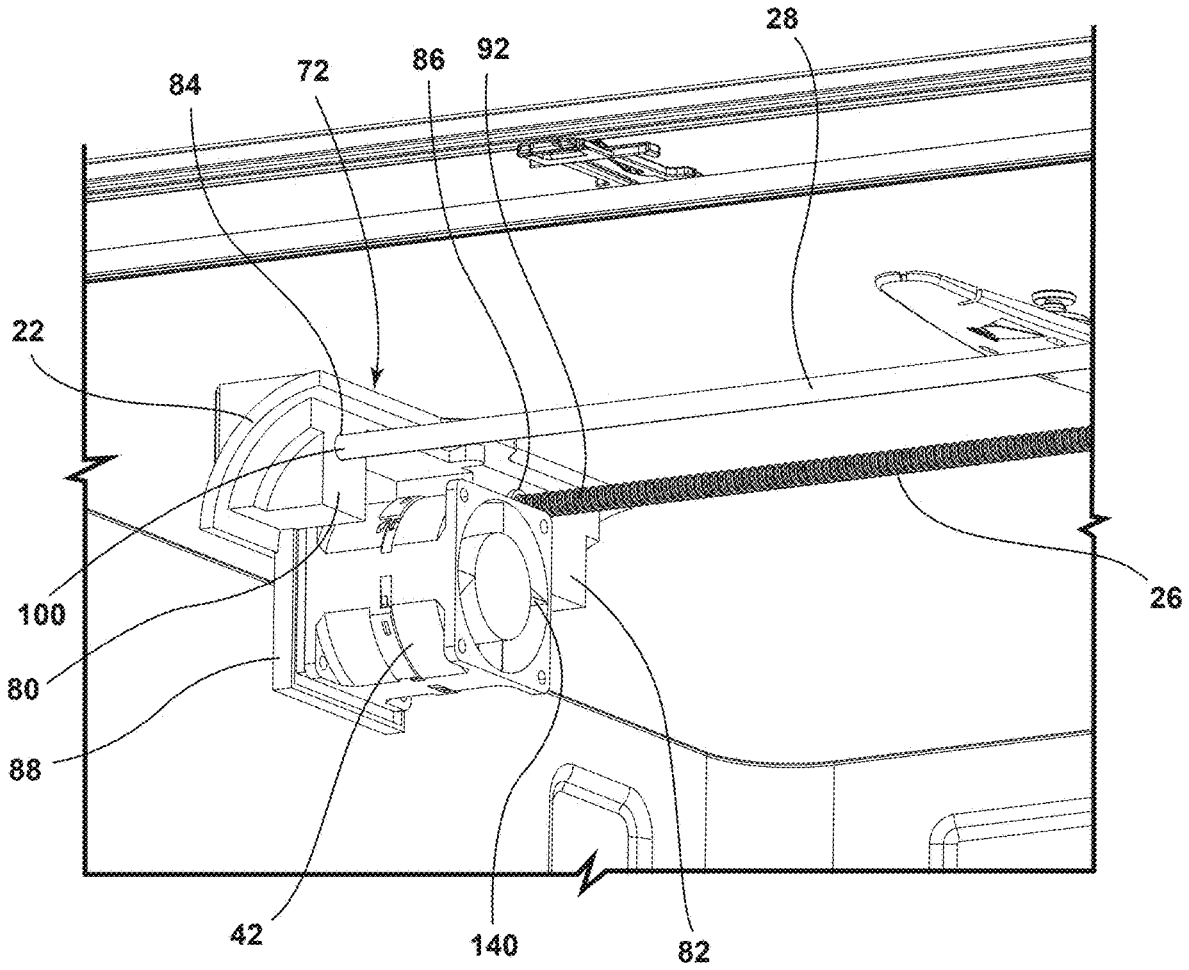
FIG. 8 is a side perspective view of a blower of an air knife assembly abutting an internal portion of a housing in a stowed state, according to the present disclosure.

Referring to FIGS. 3-5, the lead screw 26 is operably coupled to the driveshaft 90 of the motor 24 and extends horizontally across the full width of the washing chamber 20 between the opposing sidewalls 16, 18 of the tub 12. A first end 92 of the lead screw 26 is disposed within the recess 86 of the lateral projection 70 of the housing 22 to engage the driveshaft 90 of the motor 24. A second end 94 of the lead screw 26, opposite the first end 92, is coupled to a retaining feature 96 on the opposing sidewall 18 of the tub 12.

The lead screw 26 is threaded and configured to engage with corresponding threads of a lead nut 98 that is coupled to the air knife assembly 30, as described herein. Activation of the motor 24 drives rotation of the lead screw 26 allowing for linear translation of the air knife assembly 30 across the full width of the top wall 14 of the tub 12 as described further herein.

The dishwasher 10 also includes the support member 28 for supporting and/or increasing stability of the air knife 36 along with the lead screw 26. The support member 28 is disposed in the recess 84 of the lateral projection 68 of the housing 22 and extends horizontally across the full width of the washing chamber 20 between the opposing sidewalls 16, 18. The support member 28 is generally spaced from and parallel to the lead screw 26 to assist in guiding movement of the air knife assembly 30. The support member 28 forms an elongated rigid bar or rail having a first end 100 disposed within the recess 84 of the lateral projection 68 of the housing 22, and a second end 102 coupled to the retaining feature 96 on the opposing sidewall 18 of the tub 12. The support member 28 provides a linear guiding feature along its longitudinal length to support and/or stabilize the air knife assembly 30 when the air knife assembly 30 is in the deployed state 34.

The retaining feature 96 couples the lead screw 26 and the support member 28 to the opposing sidewall 18 of the tub 12. The retaining feature 96 is coupled to the top wall 14 of the tub 12 via a plurality of fasteners 104, and includes a body 106 having flanges 108, 110 that extend from the body 106. The second end 94 of the lead screw 26 is coupled to the flange 110 and the second end 102 of the support member 28 is coupled to the flange 108, allowing the lead screw 26 and the support member 28 to be held in a more precise horizontal orientation across the width of the tub 12 to provide movement and structural support to the air knife assembly 30. Additionally, the retaining feature 96 is positioned at a height and depth equivalent to the internal portion 72 of the housing 22 to provide for a straight orientation (i.e., not diagonal) for the lead screw 26 and the support member 28 in the tub 12.

The lead screw 26 and the support member 28 are supported by the housing 22 and the retaining feature 96. The housing 22 and the retaining feature 96 generally have curved shapes, following the shapes of the corners between the top wall 14 and the sidewalls 16, 18, respectively. The curved shape reduces the distance the housing 22 and the retaining feature 96 extend into the washing chamber 20 to reduce any potential impingement on the various functions and operations of the dishwasher 10.

Figure 9:
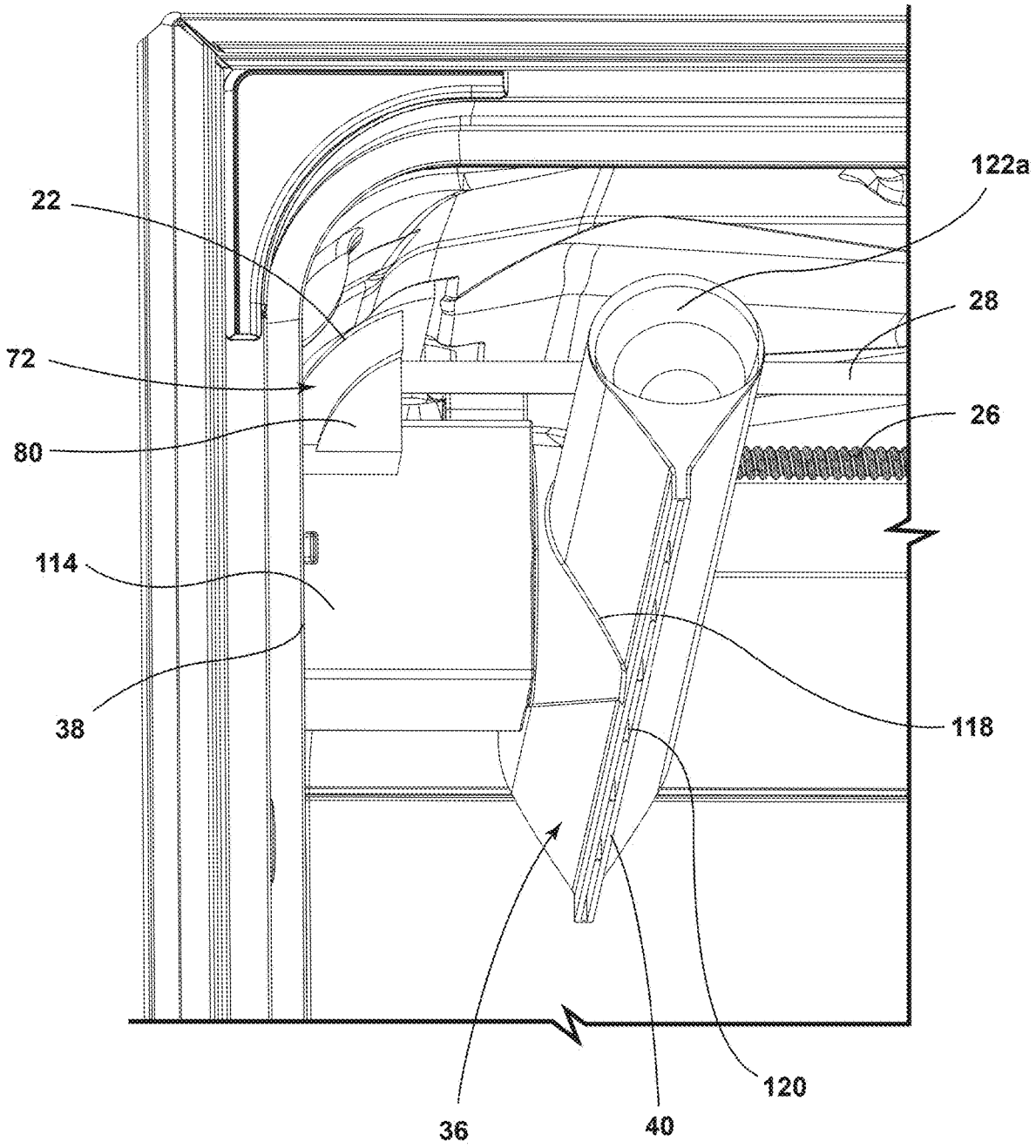
FIG. 9 is a bottom perspective view of an air knife assembly in a stowed state, according to the present disclosure.
Figure 10:
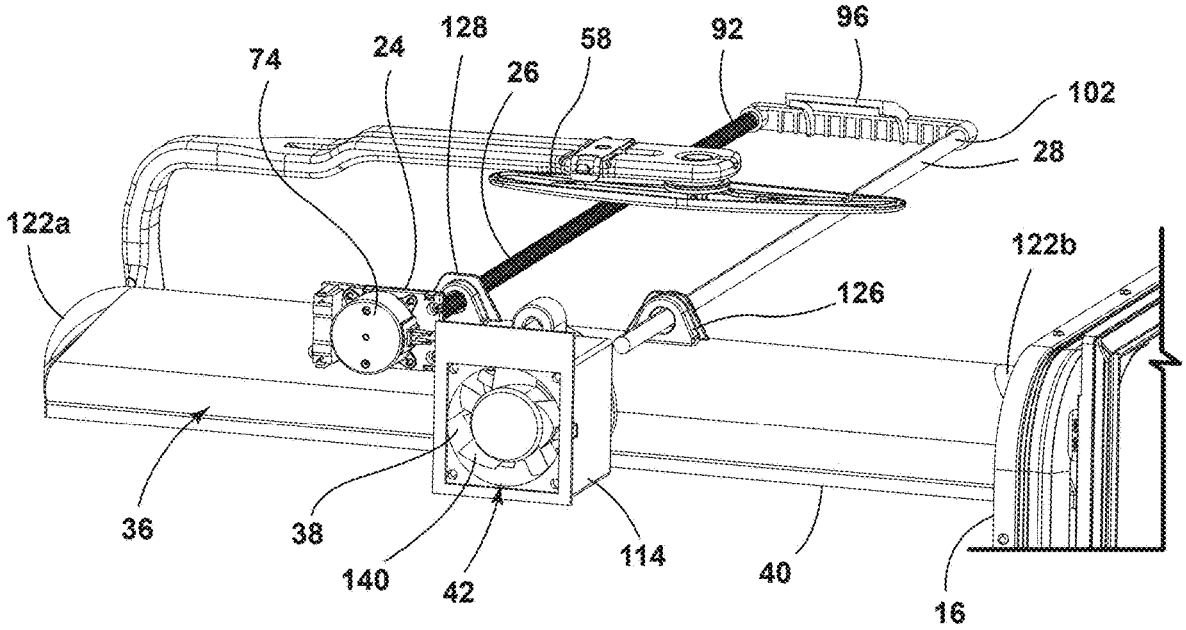
FIG. 10 is a side perspective view of an air knife assembly operably coupled to a lead screw and a support member with a tub of the dishwashing appliance removed, according to the present disclosure.
Figure 11:
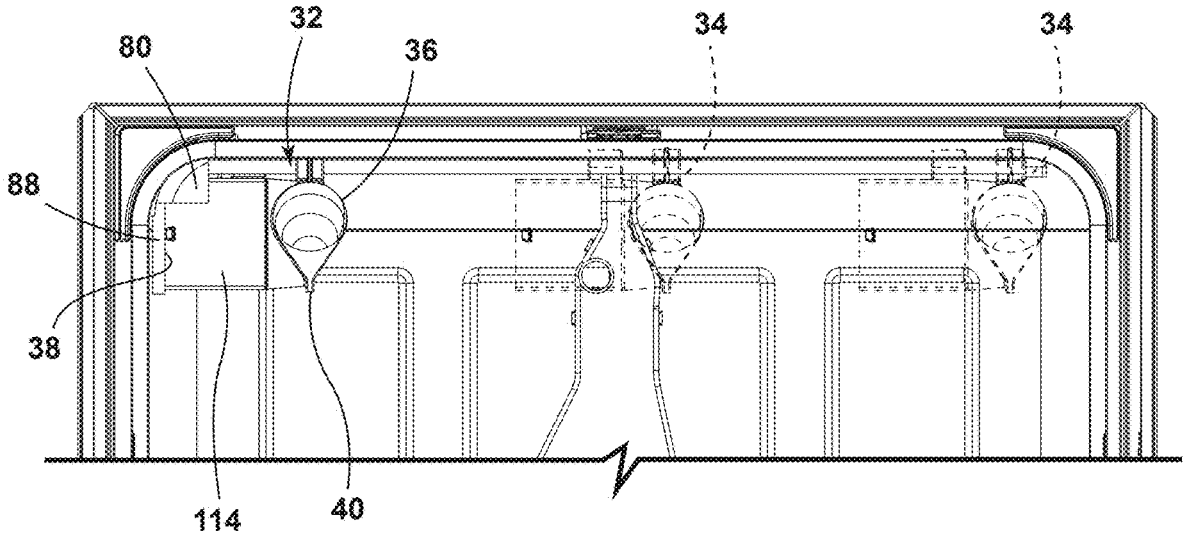
FIG. 11 is a front elevational view of an air knife assembly in a stowed state and illustrates the air knife assembly in phantom in a deployed state, according to the present disclosure.

Referring to FIGS. 4-11, the dishwasher 10 includes the air knife assembly 30 that is operably coupled to the lead screw 26 and the support member 28. The air knife assembly 30 is operable between the stowed state 32, as illustrated in FIG. 9, and the deployed state 34, as illustrated in FIG. 11. In the stowed state 32, the air knife assembly 30 abuts the housing 22 and is positioned in the receiving cavity 88. The air knife assembly 30 is generally retained in the stowed state 32 during the various wash cycles of the dishwasher 10 to reduce or prevent water leakage into the air knife assembly 30. Accordingly, the air knife assembly 30 is positioned in and/or abuts a raised perimeter 112 of the receiving cavity 88 proximate the side projections 80, 82 of the housing 22 to provide a seal for the air inlet 38 of the air knife assembly 30 during the wash cycle. Accordingly, the raised perimeter 112 surrounds or extends along an end of a blower housing 114 to seal the air inlet 38, and the seal protects the air knife assembly 30 from internal damage due to water leakage during the wash cycle.

In the deployed state 34, activation of the motor 24 drives rotation of the lead screw 26, which engages the lead nut 98 on the air knife assembly 30. This engagement drives movement of the air knife assembly 30 linearly along the lead screw 26 and the support member 28 across substantially the full width of the top wall 14 of the tub 12 and between opposing sidewalls 16, 18. The air knife assembly 30 is moved to the deployed state 34 when spaced from the housing 22 and moving across the tub 12 upon completion of the various wash cycles and prior to the drying cycle of the dishwasher 10.

The air knife assembly 30 includes the air knife 36 that is configured to direct the air curtain 44 towards the dishes 46 disposed in the dishrack 54*a*, 54*b*. The air knife 36 includes an elongated body 116 that extends between the rear wall 50 of the tub 12 and the front opening 48 of the dishwasher 10. In this way, the air knife 36 extends along a substantial portion of a depth of the top wall 14 and the tub 12. The elongated body 116 of the air knife 36 also includes a central opening 118 in fluid communication with the blower 42 and a slit 120 forming the air outlet 40 of the air knife 36.

Additionally, the elongated body 116 generally has a narrow "tear-drop" cross-sectional geometry and includes rounded ends 122*a*, 122*b* that enclose an internal air flow passageway 124 of the air knife 36. The "tear-drop" geometry of the elongated body 116 assists in transferring the air from the internal air flow passageway 124, with a reduction of internal turbulence, into the pressurized flow of air provided by the air curtain 44 in a downward direction toward the dishes 46 disposed in the upper dishrack 54*a* when the air knife assembly 30 is in the deployed state 34.

The slit 120 forming the air outlet 40 extends between the rounded ends 122*a*, 122*b* of the elongated body 116 of the air knife 36. Accordingly, the slit 120 is elongated, extending a substantial depth of the tub 12. The slit 120 is a generally elongated, narrow, nozzle-like opening with a width less than about 2 mm, for example between about 1.3 mm and about 1.7 mm, that enables the air within the internal air flow passageway 124 of the elongated body 116 of the air knife 36 to form a more uniform, pressurized air curtain 44. Further, the slit 120 allows the air curtain 44 to be fan-shaped along the depth of the tub 12. Accordingly, the nozzle-like design of the slit 120 facilitates directed air flow to produce a high-velocity air curtain 44 capable of removing excess water and moisture on the dishes 46 disposed in the upper dishrack 54*a* when the air knife assembly 30 is in the deployed state 34.

The position of the central opening 118 relative to the elongated body 116 provides a central entry of the air into the internal air flow passageway 124. The air is directed by the elongated body 116 along the length of the elongated body 116 to the rounded ends 122*a*, 122*b*. In other words, the position of the central opening 118 assists with more evenly directing air along the full length/depth of the air knife 36 and, consequently, to the depth of the dishrack 54*a*. The rounded ends 122*a*, 122*b* of the elongated body 116 of the air knife 36 provide more efficient coverage of airflow over a substantial or full depth and width of the dishrack 54*a* during translation of the air knife assembly 30 when in the deployed state 34. As air is directed through the elongated body 116 of the air knife 36, the air is dynamically compressed through the smoothly tapered inner profile of the elongated body 116 to achieve the air curtain 44.

The air curtain 44 creates a flat sheet-like air jet profile extending across the length and width of the slit 120 defining the air outlet 40. The air curtain 44 transfers pressurized air to residual pools of water or excess moisture on the dishes 46 via fluid shearing actions, thereby displacing moisture on the dishes 46 under optimized laminar flow conditions inside the air knife 36. The air outlet 40 of the air knife 36 is between about 200 mm and about 250 mm from the dishes 46 of the dishrack 54*a* providing for efficient water and excess moisture removal while reducing movement of or damage to the dishes 46 due to excessive pressurized air flow.

A top 125 of the elongated body 116 defines or includes attachment features 126, 128 defining apertures 130, 132. The lead nut 98 of the lead screw 26 is disposed within the aperture 132 of the attachment feature 128. The lead nut 98 and the lead screw 26 are threadably coupled to mate with one another to support the air knife assembly 30 and to move the air knife assembly 30 across the width of the tub 12.

Referring still to FIGS. 7-10, the air knife assembly 30 also includes the blower housing 114 that is coupled to and extends from the elongated body 116. The blower housing 114 defines the air inlet 38. The blower housing 114 is a generally cubed or cuboid shape, however, other shapes and dimensions may be alternatively utilized for the blower housing 114 without departing from the teachings herein. The blower housing 114 is positioned between the elongated body 116 and the housing 22. Accordingly, the elongated body 116 is spaced from the housing 22 by the blower housing 114 when the air knife assembly 30 is in the stowed state 32.

The blower 42 of the air knife assembly 30 includes a proximal end 132 proximate to the central opening 118 of the air knife 36 and a distal end 136 proximate to the air inlet 38. When in the stowed state 32, the blower housing 114 mates with or is disposed within the raised perimeter 112 of the receiving cavity 88 to abut an interior surface 138 of the receiving cavity 88 thereby generally enclosing the blower 42 and protecting the interior of the air knife assembly 30 from moisture exposure during the various wash cycles of the dishwasher 10. In certain aspects, the distal end 136 of the blower 42 abuts the interior surface 138 in the stowed state 32.

During the translation cycle of the dishwashing process, air from the washing chamber 20 of the tub 12 is drawn into the air inlet 38 of the air knife 36 by the blower 42. Blades 140 of the blower 42 direct the air through the central opening 118 and into the internal air flow passageway 124 of the elongated body 116 of the air knife 36, when the air knife assembly 30 is in the deployed state 34. Accordingly, the activation of the motor 24 causes the lead screw 26 to move, which moves the blower housing 114 away from the interior surface 138 allowing the air from the washing chamber 20 to be drawn into the air knife 36. The air is directed through the air knife 36 and is then directed in a downward direction through the slit 120 to form the air curtain 44.

Referring to FIGS. 10-13, the dishwasher 10 includes the controller 62 having a processor 142, a memory 144, and other control circuitry. Instructions or routines 146 are stored in the memory 144 and executable by the processor 142. The routines 146 can generally relate to operation of the dishwasher 10 (e.g., washing systems, drying systems, draining systems), as well as operation of the air knife assembly 30. For example, the controller 62 is configured to automatically start the translation cycle for the air knife assembly 30 between the wash cycles and the dry cycles.

Upon completion of the final wash cycle, the translation cycle of the air knife assembly 30 is automatically activated. In this way, the air knife assembly 30 is configured to automatically adjust from the stowed state 32 to the deployed state 34 in response to a signal from the controller 62. The controller 62 of the dishwasher 10 is communicatively coupled with the motor 24 to activate the motor 24. Accordingly, the controller 62 electronically sends an activation signal to the motor 24 to start linear translation of the air knife assembly 30 in preparation for the final drying cycle of the dishwashing process.

In various examples, the controller 62 is configured to signal the motor 24 to activate and rotatably drive the lead screw 26 prior to the initiation of the drying cycle. As the lead screw 26 rotates, the lead nut 98 engages with the lead screw 26 and is moved along the length of the lead screw 26, which, consequently, drives movement of the air knife assembly 30 across the width of the top wall 14 of the tub 12. The air knife assembly 30 is guided by the support member 28 concurrently with the lead screw 26. The controller 62 may be configured to monitor a position of the air knife assembly 30 to determine that the air knife assembly 30 reaches the opposing sidewall 18. In certain aspects, the full translation cycle of the air knife assembly 30 from the stowed state 32 to the opposing sidewall 18 and back to the stowed state 32 can take between approximately 150 seconds and approximately 180 seconds. The translation cycle of the air knife assembly 30 may include one, or more than one, full movement cycles from proximate the sidewall 16, to proximate the opposing sidewall 18, and back to the sidewall 16.

As the air knife assembly 30 is deployed, the blower 42 utilizes air drawn internally from within the washing chamber 20 and directs the air through the air inlet 38 of the air knife 36. The distal end 136 of the blower 42 is exposed to the washing chamber 20 when the air knife assembly 30 is in the deployed state 34 and draws in the internal air as the air knife assembly 30 moves between the opposing sidewalls 16, 18 of the tub 12. The air directed by the blower 42 provides a high-pressure, high-velocity air supply that is forced through the air outlet 40 of the air knife 36. As the air knife assembly 30 translates along the lead screw 26 across the width of the tub 12, the blower 42 continuously draws air into the air inlet 38 and directs the air inside the elongated body 116 of the air knife 36 and, consequently, through the air outlet 40 to provide the continuous, moving air curtain 44.

Referring still to FIGS. 10-13, the pressurized air supply generated by the blower 42 is directed into the central opening 118 of the air knife 36. The forced air enters the internal air flow passageway 124 of the elongated body 116 and is accelerated through the slit 120 defining the air outlet 40 of the air knife 36 to create the air curtain 44. As the air knife assembly 30 translates across the tub 12, the blower 42 directs the air through the air outlet 40 of the air knife 36 in a downward direction to form the air curtain 44 that extends from proximate a front to proximate a back of the dishrack 54*a* towards the dishes 46 to provide coverage along a substantial depth of the dishrack 54*a*. The air from the air curtain 44 is directed along a full length/depth of the air knife 36 and is evenly distributed along the air knife 36 due to the location of the central opening 118 and the shape of the rounded ends 122*a*, 122*b*.

Accordingly, the high velocity of the air from the air curtain 44 assists in the efficient removal of pools of water and moisture that are generally common on dishes 46, especially those with deep recesses, after the wash cycle. The air velocity at which the air curtain 44 directs air toward the dishes 46 is greater than about 5 m/s, such as between approximately 5 m/s and approximately 12 m/s, to provide for effective removal of the excess water or moisture from the dishes 46. In certain non-limiting aspects, the air velocity may be between approximately 8 m/s and approximately 10 m/s to maximize efficiency of the removal of the excess liquid or moisture from the dishes 46.

Figure 12:
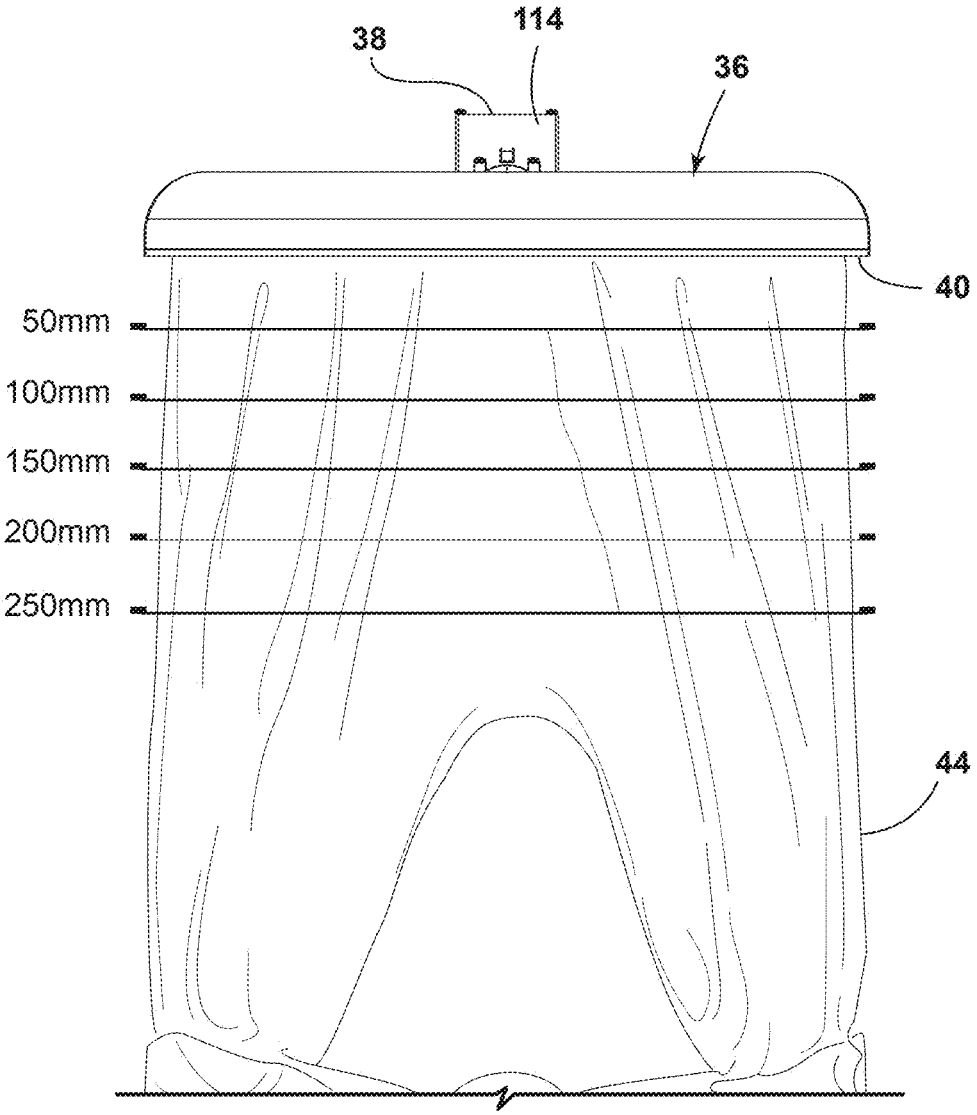
FIG. 12 is illustrative of an air curtain directed downward from an air outlet of an air knife assembly, according to the present disclosure.
Figure 13:
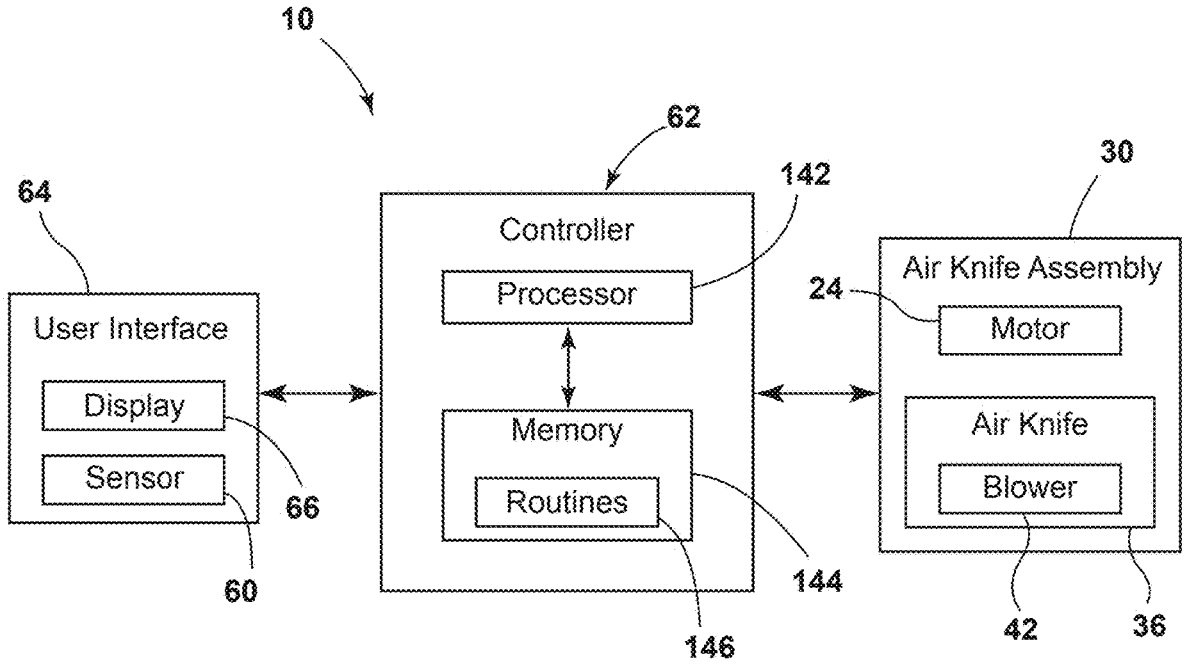
FIG. 13 is a block diagram of a dishwashing appliance with an air knife assembly, according to the present disclosure.

Referring still to FIG. 12, the air outlet 40 of the air knife 36 is generally positioned between about 200 mm and about 250 mm from the dishes 46 of the upper dishrack 54*a*, and forms an air curtain 44 that directs air toward the dishes 46 at a velocity between approximately 5 m/s and approximately 12 m/s. The selected or desired air velocity of between about 5 m/s and about 12 m/s can be maintained up to a distance of between approximately 200 mm and approximately 250 mm from the air outlet 40 (i.e. the nozzle) for effective removal of the excess liquid or moisture from the dishes 46. Accordingly, as illustrated in FIG. 12, the air forming the air curtain 44 moves at a velocity between about 5 m/s and 12 m/s at the air outlet 40 and at a distance of between at least about 200 mm and about 250 mm from the air outlet 40. In this way, the air velocity may be maintained from the air outlet 40 to the dishes 46 and/or the dishrack 54*a* up to approximately 250 mm, or farther, for providing an efficient air curtain 44 to achieve liquid reduction or removal from the dishes 46.

Figure 14:
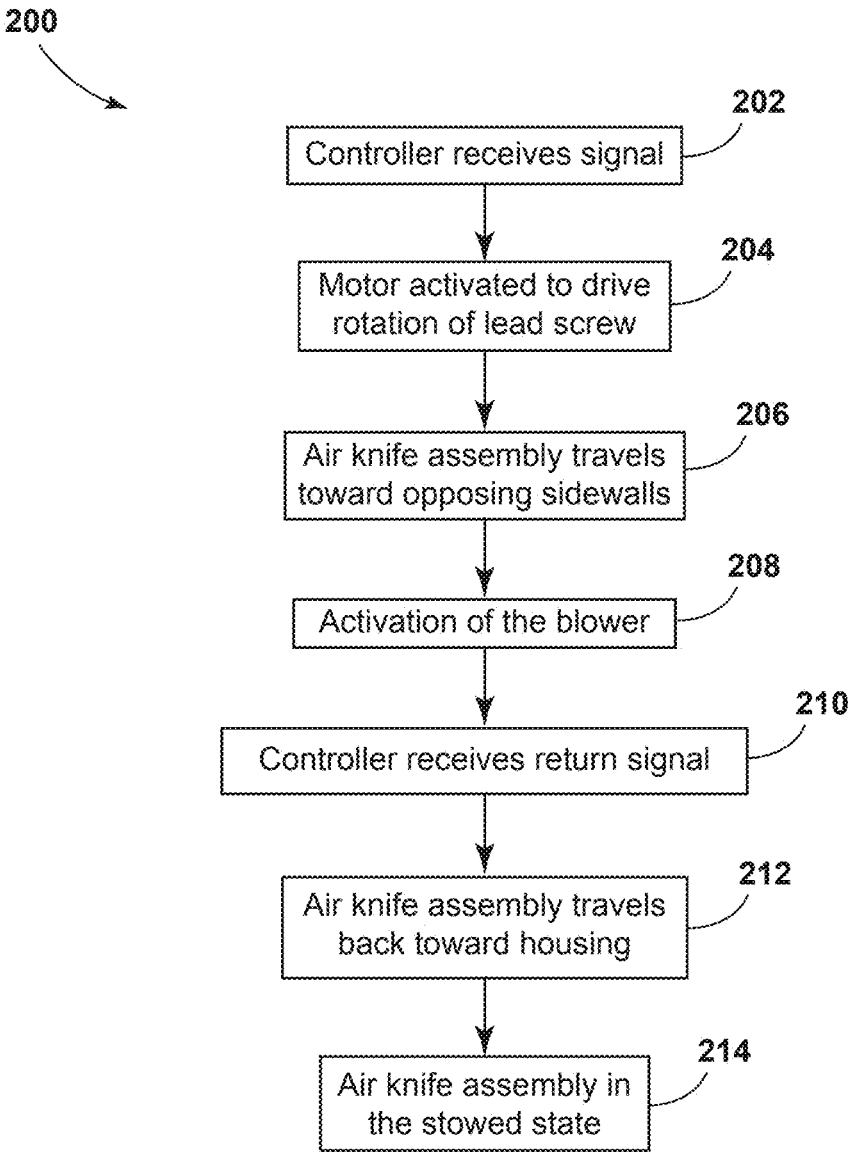
FIG. 14 is a flow diagram of a method of operating an air knife assembly of a dishwashing appliance, according to the present disclosure.

With reference to FIG. 14, as well as FIGS. 1-12, a method 200 of operation of the air knife assembly 30 of the dishwasher 10 includes step 202, where the controller 62 of the dishwasher 10 receives an activation signal from the user via the user interface 64 to initiate one or more dishwashing processes or cycles. In step 204, the controller 62 is configured to activate the motor 24 in response to the signal from the sensor 60 or in response to completion of the wash cycle (e.g., based on routines 146 related to the wash cycle) to begin driving rotation of the lead screw 26. In certain aspects, the motor 24 may drive rotation of the lead screw 26 in a clockwise direction.

In step 206, the rotation of the lead screw 26 causes the air knife assembly 30 to linearly translate along and proximate to the top wall 14 of the washing chamber 20 of the tub 12 from one sidewall 16 to the opposing sidewall 18. The lead screw 26 engages the lead nut 98, which drives the movement of the air knife assembly 30 along the lead screw 26. In step 208, the controller 62 is configured to activate the blower 42. The blower 42 directs air from the air inlet 38 through the elongated body 116 of the air knife 36, generating forced air that is directed through the air outlet 40 as the air curtain 44. The air curtain 44 forms a moving, fan-shaped sheet of air that is moved along the width of the tub 12 and, consequently, the width of the upper dishrack 54*a* as the air knife assembly 30 moves, thereby reducing or removing excess water and moisture on the dishes 46 disposed in the upper dishrack 54*a*. The air knife assembly 30 travels from opposing sidewall 16 to opposing sidewall 18 between about 75 seconds and about 90 seconds.

In step 210, the controller 62 receives a predetermined return signal that activates or adjusts the motor 24 to begin driving rotation of the lead screw 26 in an opposing direction, such as a counterclockwise direction. The return signal may be based on a sensed position of the air knife 36, stored movement time in the controller 62, etc. The opposing rotation of the lead screw 26 engages the lead nut 98 to move the lead nut 98 along the lead screw 26 back toward the housing 22.

In step 212, the counterclockwise rotation of the lead screw 26 assists the air knife assembly 30 in linearly translating along and proximate to the top wall 14 of the washing chamber 20 of the tub 12 from the sidewall 18 to the sidewall 16 towards the housing 22 directing the air curtain 44 while still the downward direction toward the dishes 46 disposed on the dishrack 54*a*. Accordingly, one full translation from the housing 22, to the retention feature 84, and back to the housing 22 results in the air curtain 44 moving across the dishes 46 twice. The translation cycle of the air knife assembly 30 may utilize two full translations or four passes of the air knife 36 over the dishes 46.

In step 214, the blower housing 114 of the air knife assembly 30 is moved to be positioned in the receiving cavity 88 of the internal portion 72 of the housing 22 in the stowed state 32. In this way, the air inlet 38 is sealed by the housing 22 to reduce and prevent water and moisture from the washing chamber 20 from entering the air knife assembly 30, which can cause damage to the operational components within the air knife assembly 30 during the various cycles of the dishwasher 10. When the air knife assembly 30 is set or secured in the stowed state 32, the controller 62 is configured to initiate the final drying cycle and completes the overall dishwashing process that then prompts the user that the dishes 46 are clean. In other words, the controller 62 is configured to start the dry cycle after the air knife assembly 30 is moved from the deployed state 34 to the stowed state 32 after completion of the translation cycle.

The final dry cycle may be more efficient due to the removal of water and moisture by the air knife assembly 30. While the air knife assembly 30 is described as reducing water and moisture on dishes 46 in the upper dishrack 54*a*, the air may flow through the dishes 46 on the upper dishrack 54*a*, or the translation cycle may be performed with few or new dishes in the upper dishrack 54*a*. In such examples, the air may assist in reducing or removing water and moisture from dishes in the lower dishrack 54*b*. The steps 202-214 of the method 200 may be performed in any order, concurrently, in sequence, repeated, omitted, etc. without departing from the teachings herein.

Use of the present assembly may provide for a variety of advantages. For example, the air knife 36 of the air knife assembly 30 may provide a pressured fan-shaped jet of air in the form of the air curtain 44 from the air outlet 40. Additionally, the air curtain 44 is directed in the downward direction across the substantial or full depth of the upper dishrack 54*a* to remove excess water and moisture from the dishes 46, for example, the recesses of dishes 46 that tend to pool excess water in the form of puddles. Moreover, movement of the air knife 36 from proximate one sidewall 16 to the opposing sidewall 18 causes the air knife 36 to travel and, consequently, direct the air curtain 44 along the substantial or full width of the upper dishrack 54*a*. Additionally, air may flow through the dishes 46 on the upper dishrack 54*a* and assist with removing water or moisture from the lower dishrack 54*b*. Further, the elongated body 116 of the air knife 36 is generally a tear-drop shape that includes a rounded portion and a narrow portion, where the rounded portion of the elongated body 116 assists in reducing internal turbulence of air to provide a uniform and consistent stream of air via the air outlet 40 and the narrow portion of the elongated body 116 includes the slit 120 that forms the air outlet 40. Additionally, the slit 120 generally forms a nozzle-like opening that assists in the facilitation of a direct flow of air via the air curtain 44 in a downward direction towards the dishes 46 of the upper dishrack 54*a*. Additional benefits and advantages may be realized and/or achieved.

The device disclosed herein is further summarized in the following paragraphs and is further characterized by combinations of any and all of the various aspects described therein.

According to another aspect of the present disclosure, a dishwasher includes a tub having a top wall and opposing sidewalls that at least partially define a washing chamber. A housing coupled to the top wall of the tub. A motor disposed in the housing. A lead screw operably coupled to the motor, the lead screw extends between the opposing sidewalls of the tub. A support member coupled to the housing, the support member extends between the opposing sidewalls of the tub, and an air knife assembly operably coupled to the lead screw and the support member. The air knife assembly is operable between a stowed state abutting the housing and a deployed state moving along the lead screw and the support member between the opposing sidewalls. The motor drives rotation of the lead screw to move the air knife assembly, the air knife assembly including, an air knife defining an air inlet and an air outlet, and a blower coupled to the air knife. The blower is configured to direct air through the air outlet of the air knife to generate an air curtain when the air knife assembly is in the deployed state.

According to another aspect, a tub includes a rear wall and defines a front opening opposite the rear wall. An air knife extends between the rear wall and the front opening.

According to yet another aspect, a support member and a lead screw are spaced apart and parallel to one another.

According to another aspect, a dishwasher further includes a retaining feature coupled to a top wall of a tub opposite a housing, wherein a lead screw and a support member are coupled to the retaining feature.

According to yet another aspect, a dishwasher further includes a dishrack disposed in a washing chamber, wherein an air knife assembly is configured to direct an air curtain on the dishrack and move the air curtain across a width of the dishrack when in a deployed state.

According to yet another aspect, a dishwasher further includes a controller communicatively coupled to a motor and an air knife assembly, wherein the controller is configured to activate the motor to automatically move the air knife assembly from a stowed state to a deployed state in response to completion of a wash cycle.

According to another aspect, a controller is configured to start a dry cycle after an air knife assembly is moved from a deployed state to a stowed state after completion of a translation cycle of an air knife assembly.

According to another aspect, a dishwasher includes a tub having a top wall and a housing coupled to the top wall of the tub. The housing defines a receiving cavity. A motor is disposed in the housing. A lead screw is operably coupled to the motor and the tub. A support member is coupled to the housing and the tub, and an air knife assembly is operably coupled to the lead screw and the support member. The air knife assembly is operable between a stowed state and a deployed state. The air knife assembly includes an air knife defining a slit forming an air outlet. The motor drives rotation of the lead screw to translate the air knife assembly along the lead screw when in the deployed state. A blower housing is coupled to the air knife. The blower housing is configured to be positioned in the receiving cavity and abut the housing when the air knife assembly is in the stowed state to seal an air inlet of the air knife assembly. A blower disposed in the blower housing. The blower is configured to direct air through the air outlet to generate an air curtain when the air knife assembly is in the deployed state.

According to yet another aspect, an air knife includes an elongated body having opposing rounded ends, and wherein a blower housing is positioned between an elongated body and a housing.

According to another aspect, a top of an elongated body of an air knife defines attachment features configured to engage a lead screw and a support member, respectively.

According to another aspect, a housing includes a raised perimeter in a receiving cavity, and wherein the raised perimeter is configured to surround a blower housing in a stowed state.

According to yet another aspect, a housing includes first and second projections on opposing sides of a receiving cavity, wherein a lead screw is coupled to the first projection and a support member is coupled to the second projection.

According to another aspect, an air knife extends substantially along the width of the top wall of the tub.

According to another aspect, a dishwasher further includes a retaining feature coupled to a tub on an opposing side relative to a housing, wherein the retaining feature is coupled to and supports a lead screw and a support member.

According to yet another aspect, a dishwasher includes a tub having a top wall and first and second sidewalls. The tub defines a washing chamber and an opening in the top wall. A dishrack is disposed in the washing chamber and configured to hold dishes. A housing is disposed in the opening of the top wall of the tub proximate to the first sidewall. A motor is disposed in the housing, and a lead screw is operably coupled to the motor. The lead screw extends between the motor housing and the second sidewall. An air knife assembly is operably coupled to the lead screw. The air knife assembly includes an air knife defining an air inlet and an air outlet. The air outlet forms an elongated slit. A blower housing is coupled to the air knife, and a blower is disposed in the blower housing. The blower is configured to direct air through the air outlet of the air knife to generate an air curtain in a downward direction across a depth of the dishrack, the elongated slit forming the air curtain in a fan shape.

According to another aspect, an air knife includes a central opening in fluid communication with a blower.

According to another aspect, a blower includes a proximal end proximate a central opening of an air knife and a distal end proximate an air inlet, wherein the distal end of the blower abuts a housing when the air knife assembly is in a stowed state to protect the air inlet of the air knife during a wash cycle.

According to another aspect, a motor drives rotation of a lead screw to linearly translate an air knife assembly along the lead screw upon completion of a wash cycle.

According to yet another aspect, an air knife assembly travels from a first sidewall to a second sidewall to move an air curtain across a width of a dishrack.

According to another aspect, air forming an air curtain is moving at a velocity between 5 m/s and 12 m/s at a distance of between 200 mm and 250 mm from the air outlet.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A dishwasher, comprising:

a tub having a top wall and opposing sidewalls that at least partially define a washing chamber;

a housing coupled to the top wall of the tub;

a motor disposed in the housing;

a lead screw operably coupled to the motor, wherein the lead screw extends between the opposing sidewalls of the tub;

a support member coupled to the housing, wherein the support member extends between the opposing sidewalls of the tub; and an air knife assembly operably coupled to the lead screw and the support member, wherein the air knife assembly is operable between a stowed state abutting the housing and a deployed state moving along the lead screw and the support member between the opposing sidewalls, and wherein the motor drives rotation of the lead screw to move the air knife assembly, the air knife assembly including:

an air knife defining an air inlet and an air outlet; and a blower coupled to the air knife, wherein the blower is configured to direct air through the air outlet of the air knife to generate an air curtain when the air knife assembly is in the deployed state.

2. The dishwasher of claim 1, wherein the tub includes a rear wall and defines a front opening opposite the rear wall, and wherein the air knife extends between the rear wall and the front opening.

3. The dishwasher of claim 1, wherein the support member and the lead screw are spaced apart and parallel to one another.

4. The dishwasher of claim 1, further comprising:

a retaining feature coupled to the top wall of the tub opposite the housing, wherein the lead screw and the support member are coupled to the retaining feature.

5. The dishwasher of claim 1, further comprising:

a dishrack disposed in the washing chamber, wherein the air knife assembly is configured to direct the air curtain toward the dishrack and move the air curtain across a width of the dishrack when in the deployed state.

6. The dishwasher of claim 1, further comprising:

a controller communicatively coupled to the motor and the air knife assembly, wherein the controller is configured to activate the motor to automatically move the air knife assembly from the stowed state to the deployed state in response to completion of a wash cycle.

7. The dishwasher of claim 6, wherein the controller is configured to start a dry cycle after the air knife assembly is moved from the deployed state to the stowed state after completion of a translation cycle of the air knife assembly.

8. A dishwasher, comprising:

a tub having a top wall;

a housing coupled to the top wall of the tub, wherein the housing defines a receiving cavity;

a motor disposed in the housing;

a lead screw operably coupled to the motor and the tub;

a support member coupled to the housing and the tub; and an air knife assembly operably coupled to the lead screw and the support member, wherein the air knife assembly is operable between a stowed state and a deployed state, the air knife assembly including:

an air knife having an elongated body defining a slit forming an air outlet, wherein the motor drives rotation of the lead screw to translate the air knife assembly along the lead screw when in the deployed state; and a blower housing coupled to the elongated body, wherein the blower housing is configured to be positioned in the receiving cavity and abut the housing when the air knife assembly is in the stowed state to seal an air inlet of the air knife assembly; and a blower disposed in the blower housing, wherein the blower is configured to direct air through the air outlet to generate an air curtain when the air knife assembly is in the deployed state.

9. The dishwasher of claim 8, wherein the elongated body has opposing rounded ends, and wherein the blower housing is positioned between the elongated body and the housing.

10. The dishwasher of claim 8, wherein a top of the elongated body of the air knife defines attachment features configured to operably engage the lead screw and the support member, respectively.

11. The dishwasher of claim 8, wherein the housing includes a raised perimeter in the receiving cavity, and wherein the raised perimeter is configured to surround the blower housing in the stowed state.

12. The dishwasher of claim 8, wherein the housing includes first and second projections on opposing sides of the receiving cavity, wherein the lead screw is coupled to the first projection and the support member is coupled to the second projection.

13. The dishwasher of claim 8, wherein the air knife extends substantially along a depth of the top wall of the tub.

14. The dishwasher of claim 8, further comprising:

a retaining feature coupled to the tub on an opposing side relative to the housing, wherein the retaining feature is coupled to and supports the lead screw and the support member.

15. A dishwasher, comprising:

a tub having a top wall and first and second sidewalls, the tub defining an opening in the top wall and a washing chamber;

a dishrack disposed in the washing chamber and configured to hold dishes;

a housing disposed in the opening of the top wall of the tub proximate to the first sidewall;

a motor disposed in the housing;

a lead screw operably coupled to the motor, wherein the lead screw extends between the housing and the second sidewall; and an air knife assembly operably coupled to the lead screw, the air knife assembly including:

an air knife defining an air inlet and an air outlet, wherein the air knife defines an elongated slit to form the air outlet, and wherein the air knife includes a blower housing; and a blower disposed in the blower housing, wherein the blower is configured to direct air through the air outlet of the air knife to generate an air curtain in a downward direction across a depth of the dishrack, the elongated slit forming the air curtain in a fan shape.

16. The dishwasher of claim 15, wherein the air knife includes a central opening in fluid communication with the blower.

17. The dishwasher of claim 16, wherein the blower includes a proximal end proximate the central opening of the air knife and a distal end proximate the air inlet, and wherein the distal end of the blower abuts the housing to protect the air inlet of the air knife during a wash cycle.

18. The dishwasher of claim 17, wherein the motor drives rotation of the lead screw to linearly translate the air knife assembly along the lead screw upon completion of the wash cycle.

19. The dishwasher of claim 15, wherein the air knife assembly travels from the first sidewall to the second sidewall to move the air curtain across a width of the dishrack.

20. The dishwasher of claim 15, wherein the air forming the air curtain is moving at a velocity between 5 m/s and 12 m/s at a distance of between 200 mm and 250 mm from the air outlet.

* * * * *